US007086263B2

(12) United States Patent
Lavaroni et al.

(10) Patent No.: US 7,086,263 B2
(45) Date of Patent: Aug. 8, 2006

(54) UNIVERSAL ROLLING STAND WITH ROLL GAP CONTROL

(75) Inventors: Giorgio Lavaroni, Buttrio (IT); Aldo Vergendo, Buttrio (IT); Loris Maestrutti, Buttrio (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 286 days.

(21) Appl. No.: 10/487,774

(22) PCT Filed: Sep. 2, 2002

(86) PCT No.: PCT/EP02/09787

§ 371 (c)(1),
(2), (4) Date: Feb. 25, 2004

(87) PCT Pub. No.: WO03/020453

PCT Pub. Date: Mar. 13, 2003

(65) Prior Publication Data

US 2004/0237620 A1 Dec. 2, 2004

(30) Foreign Application Priority Data

Sep. 4, 2001 (IT) ..... MI2001A1860

(51) Int. Cl.
*B21B 13/10* (2006.01)

(52) U.S. Cl. ..... 72/225; 72/237; 72/239; 72/245

(58) Field of Classification Search ..... 72/225, 72/237, 245, 238, 239, 248
See application file for complete search history.

(56) References Cited

U.S. PATENT DOCUMENTS

| | | | | |
|---|---|---|---|---|
| 3,196,516 | A * | 7/1965 | Bongiovanni | 164/417 |
| 3,250,105 | A * | 5/1966 | Stone | 72/240 |
| 4,127,997 | A | 12/1978 | Quehen | |
| 4,736,609 | A * | 4/1988 | Schiller et al. | 72/244 |
| 4,918,964 | A | 4/1990 | Engel et al. | |
| 5,048,411 | A * | 9/1991 | Siebert | 100/331 |
| 6,021,656 | A | 2/2000 | Bogendorfer et al. | |

FOREIGN PATENT DOCUMENTS

| | | |
|---|---|---|
| DE | 8403103 | 10/1984 |
| EP | 0 557 874 | 2/1993 |
| GB | 2 137 911 | 10/1984 |

* cited by examiner

*Primary Examiner*—Derris H. Banks
*Assistant Examiner*—Teresa M. Bonk
(74) *Attorney, Agent, or Firm*—Sampson & Associates, P.C.

(57) ABSTRACT

A universal rolling stand with control of the space between the rolls comprises a pair of horizontal rolls and one or more vertical rolls with respective chocks, positioning housings and a guide for the chocks with adjustment tie rods (6, 7, 6', 7', 18, 18', 19, 19') anchored on one side to the housings and acting on the chocks for the adjustment and positioning of the rolls. Adjustment is performed by means of hydraulic capsules (8, 8', 9, 9', 20, 20', 21, 21') with two hydraulic chambers with dual actuation effect and a double stem at the ends of each tie rod.

11 Claims, 3 Drawing Sheets

UNIVERSAL ROLLING STAND WITH ROLL GAP CONTROL

This application claims priority to International Patent Application Serial No. PCT/EP02/09787 filed on 2 Sep. 2002, claiming priority to Italian Patent Application Serial No. MI12001A001860 filed on 4 Sep. 2001.

FIELD OF THE INVENTION

The present invention refers to a process and to a universal rolling stand with roll gap control.

PRIOR ART

Universal rolling stands are used principally in the production of rolled sections with bent edges and of T-beams, H-beams, etc. Universal rolling stands are generally composed of a pair of rolls with a horizontal axis and one or two rolls with a vertical axis placed on one side or on both sides of the horizontal axis rolls. One type of universal rolling stands of the prior art comprises a roll supporting structure composed of two monobloc connecting elements parallel to the axes of the horizontal rolls which join together the side housings of the stand. The housings in turn support the chocks which comprise the bearings for the support and rotation of the horizontal axis rolls. Instead, the vertical axis rolls are fitted in chocks placed between the columns of the housings, between the chocks of the horizontal axis rolls.

One of the problems that must be solved in this type of stands is how to find the right compromise between the rigidity of the structure of the stands reacting to the forces generated during the rolling operations, their lightness and their simplicity of construction in order to allow maintenance operations and the replacement of worn parts of the stands or of the whole stands in the shortest possible time so as to reduce down times.

In the past, to accelerate roll changing or maintenance operations, as well as to reduce the time necessary to change the rolling stands, various types of solutions have been proposed.

The Italian patent document IT-UD92A000110 describes a universal rolling stand with housings composed of common elements with a threaded spindle which ensure the regulation of the distance between the centres of the rolls. In this stand the rotating movement of the threaded spindle is transformed into a traverse movement of the supports which hold the chocks of the horizontal rolls.

The patent document IT-UD92A000022 describes a system for adjusting the closure of the vertical rolls which can be fitted in a universal stand in combination with the support structure for horizontal rolls described in IT-UD92A000110.

The patent U.S. Pat. No. 4,918,964 describes a universal stand equipped with systems for roll gap adjustement of a hydraulic type. The hydraulic cylinders have a single effect and one is applied for each of the chocks of the upper horizontal roll and for each of the vertical rolls.

The main problem presented by these types of stand is that of reducing the strain which is produced under load, remaining within the limit of the tolerances requested by the processes which must be carried out by these types of stand. The most common strains occurring in these types of stand are those deriving from the variation of the roll gap, caused by the deformation of the elastic elements that make up the stand, during lead-in of the bar and the release of the bar itself.

SUMMARY OF THE INVENTION

The main purpose of the present invention is to overcome the drawbacks described above, by providing a universal rolling stand with roll gap control and which presents an increased rigidity and improved dynamic performances.

Another purpose of the invention is to provide a stand of the above-mentioned type which allows decreased wear of its components, reduction of the number and type of manual operations, and a simplification of the structure.

These aims, along with others which will be become apparent in the following description, are achieved by means of a universal rolling stand with roll gap control having the features of claim 1.

Thanks to these features in the universal rolling stand, the two pairs of vertical tie rods which support the rolling load have a reduced length and reduced extensions because the hydraulic working chambers relative to the horizontal rolls are placed very close to the axis of the rolls themselves. The arrangement of the working chambers provided for in the new universal stand allows the load generated during rolling to be closed in a shorter path than with traditional rolling mill stands with housings that form a closed loop of forces. In general it results in an increased rigidity of the whole stand.

Thanks to a particularly advantageous embodiment of the stand according to the invention, a spherical joint placed between the connecting cross members of the actuating cylinders, solidarity with the latter, and the chocks of the horizontal rolls, allows the chocks to tilt about the axis of the tie rods. In this way, even when the rolls are subjected to the rolling load and the chocks tend to tilt, the tie rods remain straight. In this way only axial loads are exerted on the actuating cylinders, but not radial loads, with the result of increasing the duration of the gaskets of the actuating cylinders themselves.

In comparison with the traditional solutions which use stay bolts that rotate around their own axis for regulating the centre distance of the rolls, the hydraulic actuating cylinders allow the use of non rotating bolts or tie rods. This offers the advantages that the tie rods may be made with an enlarged diameter with a square section in their central area, which further increases the rigidity of these elements. Moreover the gaskets associated with the tie rods are all subjected to static stresses, so their efficiency and duration are increased with respect to the rotating gaskets used in other known solutions.

The use of double acting hydraulic actuators with a double shaft allows an improvement of the dynamic performance of the stand because the actuator response and adjustment times at lead-in and release of the bar are considerably reduced and the tolerances that can be obtained on the product are improved. Further advantages connected to the use of actuating cylinders consist of the fact that the rigidity of the double acting actuating cylinder is double that of the single-acting cylinder and that the additional external balancing rolls and their respective hydraulic controls have been eliminated.

The use of hydraulic actuating cylinder on the support according to the invention, located in correspondence to the tie rods also avoids problems due to peak loads. This is because the tie rods always work under traction and never under compression, as happens instead in stands with closed housings of the prior art, where the strokes must be reduced due to the occurrence of peak load instability. Consequently it is not necessary to insert shims between actuating cylinder and chocks to cover the whole interval of values that the roll centre distance can assume, Thanks to the feature which also provides for a mechanical preload by means of springs, it is possible to eliminate the clearance between spherical joint and chock. In a particular embodiment, the preload in a spherical joint is also provided to allow the oscillation of the chock and the preloading is adjustable so as to balance adequately the weight of roll and chock.

The double acting hydraulic actuators with double stem have sections with slightly different dimensions in the two working chambers so that, in the case of an emergency, the space between the rolls is automatically opened by the emergency hydraulic circuit In a preferred embodiment of the invention, since the stand has a modular structure and automatic or semiautomatic hydraulic controls, it needs less intervention of human operators with reduction of risks for the safety of the latter.

The stand structure is much simplified, too.

In the stand according to the invention, certain manual operations are eliminated and others are reduced or simplified and automated so that the time for changing the rolls is much shorter than with other stands of the prior art.

Another advantage of the invention consists of the fact that the use of hydraulic actuating cylinders in the universal stands according to the invention allows an independent regulation of the roll, for example between the upper horizontal roll and the lower horizontal roll. This is particularly important, above all when rolling beams with sections not symmetrical with respect to the horizontal axis.

BRIEF DESCRIPTION OF THE FIGURES

Further characteristics and advantages of the invention will become apparent from the detailed description of a preferred, but not exclusive embodiment of a universal rolling stand with roll gap control, illustrated hereafter by way of a non-limiting example with the aid of the enclosed drawings in which.

DESCRIPTION OF A PREFERRED EMBODIMENT

Figure 1:
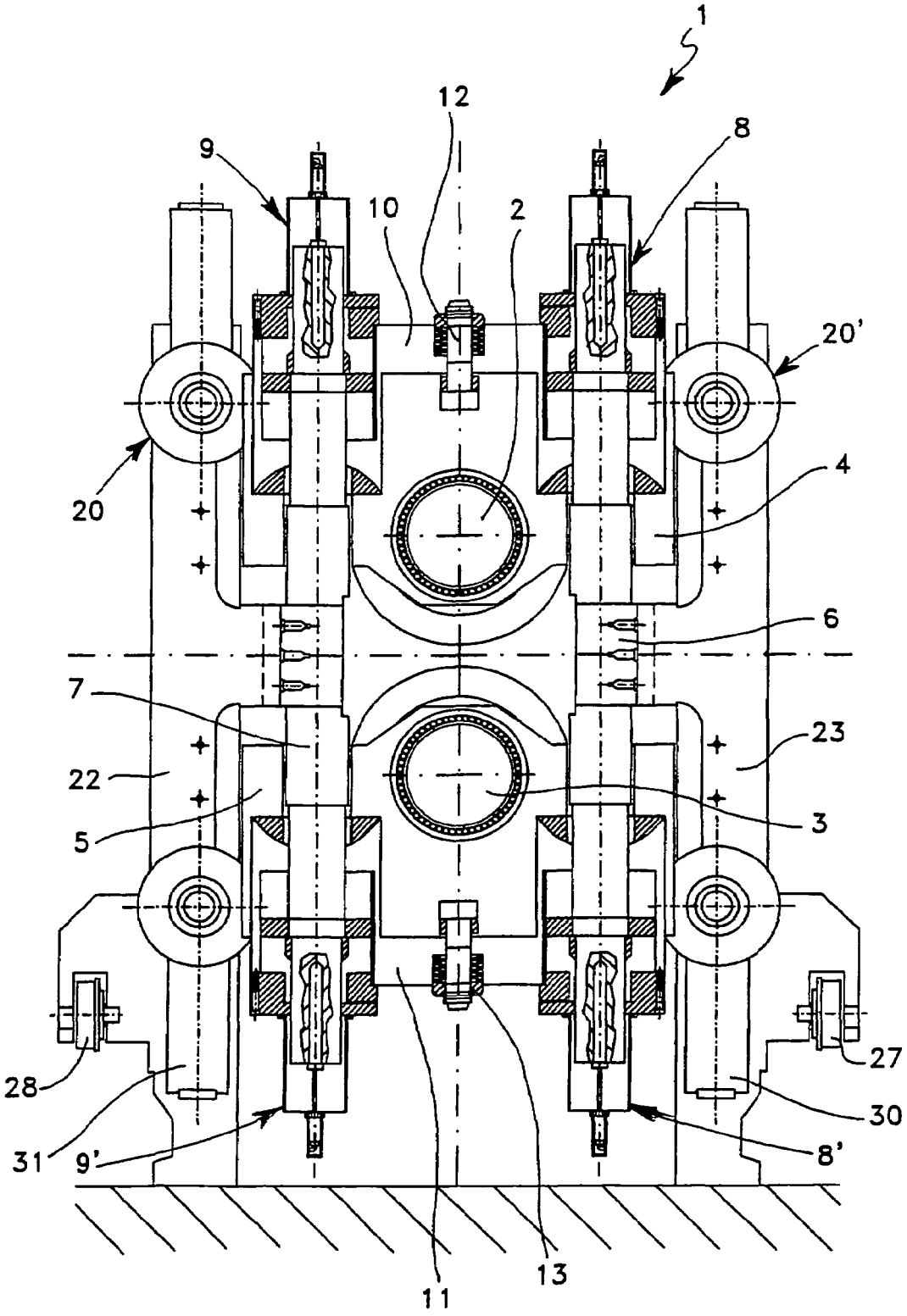
FIG. 1 represents a section along a plane orthogonal to the axes of the horizontal rolls of a universal rolling stand according to the invention.
Figure 3:
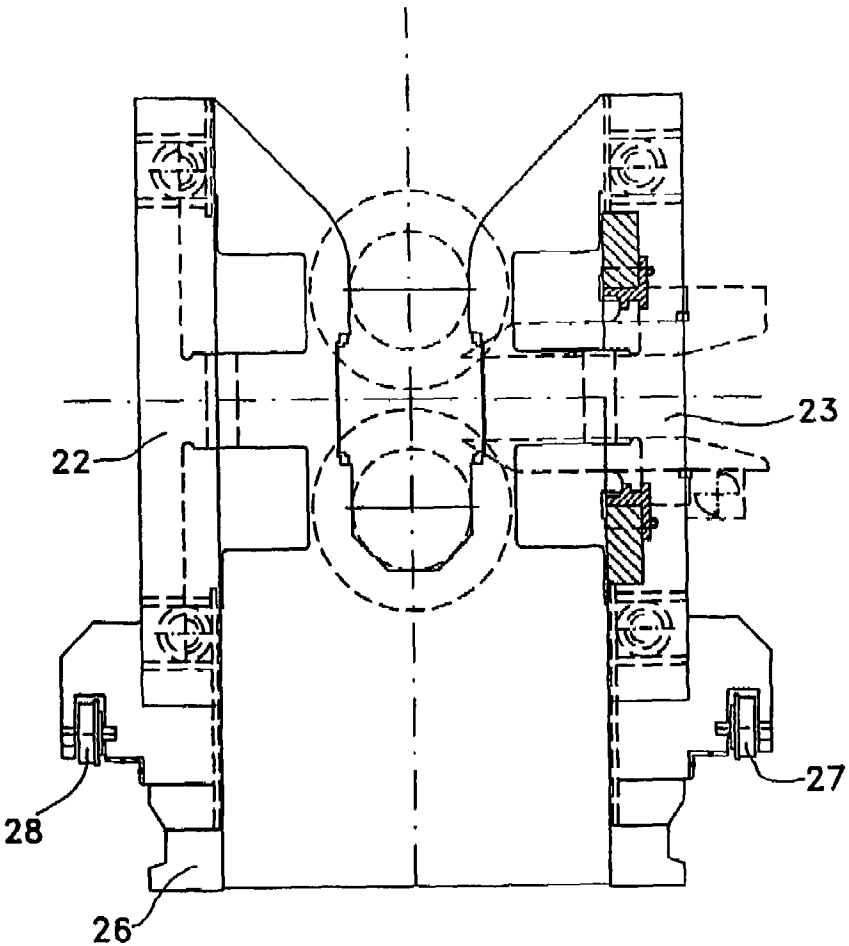
FIG. 3 represents a side view of another element of the stand of FIG. 1, FIGS. 4, 5, 6 represent plan views of elements of the stand in FIG. 1.
Figure 2:
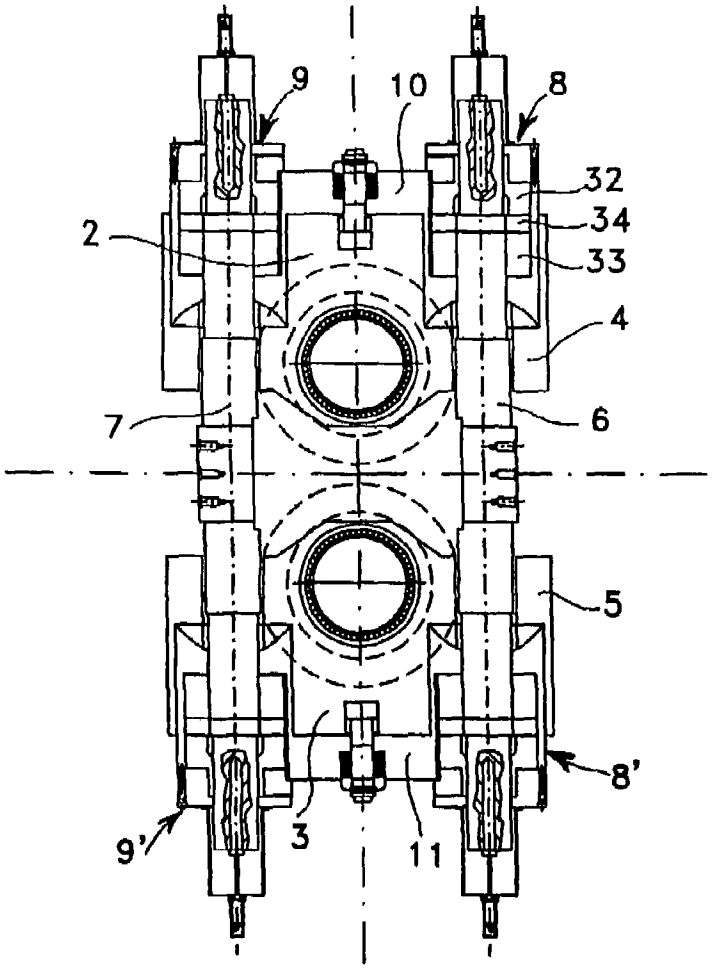
FIG. 2 represents a cross section of an element of the stand of FIG. 1.

With particular reference to the figures mentioned, the universal rolling stand globally indicated with the reference numeral 1 comprises two rolls with horizontal axis 1, 3, mounted on four chocks 4, 5, two for each of the horizontal rolls, of which only the ones placed at one side of the stand are visible in FIG. 1. The other two chocks placed on the hidden side of the stand in FIG. 1 are perfectly identical to the previous ones and are not further described in detail.

On each side of the stand are placed two vertical tie rods 6, 6', 7, 7' which fix the two chocks 4, 5 of the horizontal rolls 2, 3. On each of the two tie rods 6, 7 are fitted two hydraulic actuating cylinders 8, 8', 9, 9', one near the upper roll 2 and the other near the lower roll 3.

The four tie rods of the stand 1, both of the part on view and of the hidden part, are fixed and cannot turn around their own axis, unlike the stay bolts of prior art stands.

On each side of the stand 1 there are two cross members 10, 11, one at the top and the other at the bottom of the stand, each connecting two respective actuating cylinders 8, 9 e 8', 9'. The upper cross member 10 acts as a support for the upper chock 4 and the lower cross member 11 for the lower chock 5, in both cases with the aid of a respective ball joint 12, 13. Springs or hydraulic devices for eliminating the clearance that can be produced in the connections with the respective cross members may be placed advantageously next to the ball joint.

Figures 4, 5, 6:
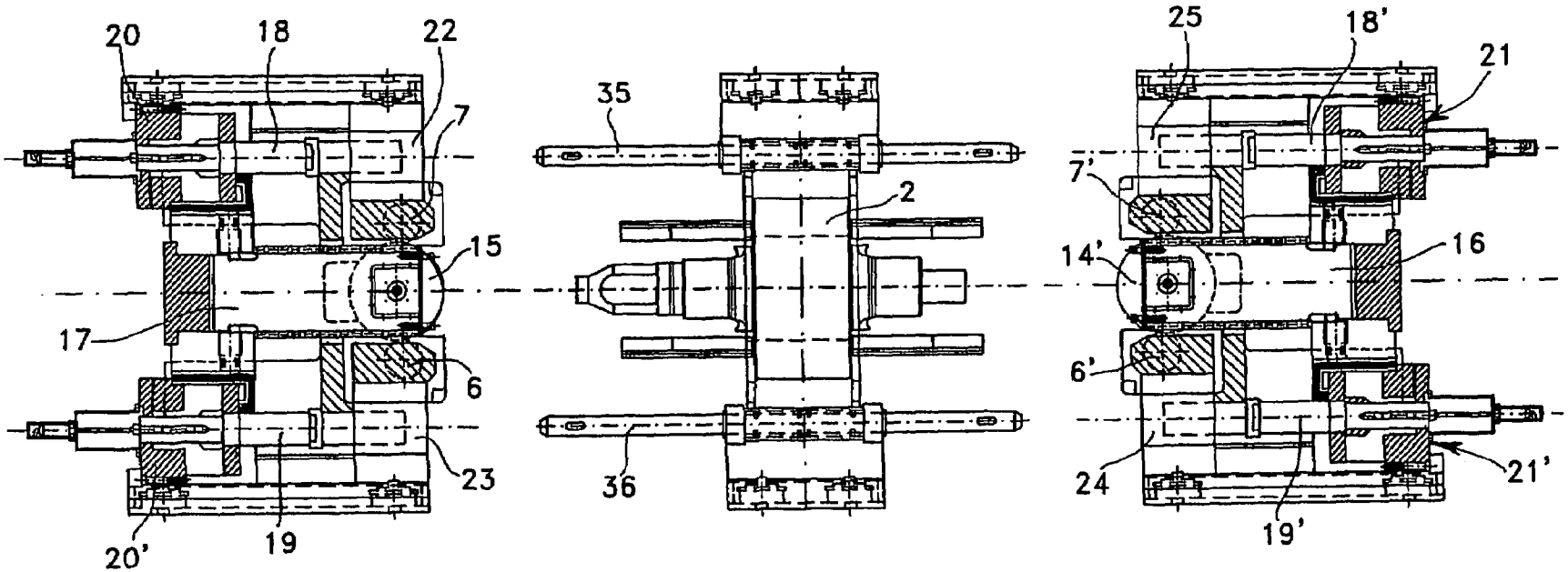

The stand also comprises two rolls 14, 15 with a vertical axis, better represented particularly in FIGS. 4 and 6, and also mounted on a respective chock 16, 17, one for each of the rolls. Next to each vertical roll are placed two respective tie rods 18, 18', 19, 19', which also do not rotate around their own axis. On each of the tie rods 18, 18', 19, 19' there is fitted a respective hydraulic actuating cylinder 20, 20', 21, 21' of the same type as those used on the tie rods of the horizontal rolls.

The tie rods of the vertical and horizontal rolls are connected together by four housings 22, 23, 24, 25, two of which are placed on the control side and two on the operator side, on which the tie rods are fixed. The housings are advantageously provided with trolleys 30, 31 sliding on guides to facilitate the movement of the housings and their handling during assembly and dismantling of the stand 1.

The stand 1 is completed by a basket 26 for supporting the rolls and the guides. Also the basket 26 is advantageously provided with trolleys 27, 28 to facilitate the movement of the whole stand 1.

The actuating cylinders used in the stand 1 according to the invention are composed of two double acting hydraulic chambers 32, 33 with a double rod separated by an intermediate piston 34 where the oil under pressure is sent to the two chambers in a suitable way to balance the rolling forces.

The main parts that make up the stand are the housings and the chocks for the horizontal and vertical rolls on the control side (LC), the housings and the chocks for the horizontal and vertical rolls on the operator side (LO) and the sandwich holding basket with a trolley, which in turn comprises the horizontal rolls, the vertical rolls with respective support, the equipment holding bars and the rolling guides. These parts can move appropriately, moving close together and opening hydraulically, sequentially and semi-automatically to perform the operations of replacing both the vertical and the horizontal rolls.

The equipment holding bars are joined to the housings LC and LO with 4 tie rods 35, 36 which are blocked with hydraulically controlled wedges and pre-tensioned with hydraulic brackets, not illustrated in detail in the figures.

The invention claimed is:

1. Universal rolling stand with roll gap control comprising upper (2) and lower (3) rolls, with a horizontal axis defining a rolling plane, said upper (2) and lower (3) rolls being associated with respective first chocks (4, 5), and comprising at least one roll with a vertical axis (14, 15), provided with own positioning and guiding second chocks (16, 17), said stand comprising moreover a number of housings (22, 23, 24, 25) for the positioning and guiding of said first (4, 5) and second (16, 17) chocks and a plurality of tie rods (6, 7, 6', 7', 18, 18', 19, 19') each being anchored to said housings and operatively connected to said first and second chocks, said tie rods being associated with means for regulating and positioning said first and second chocks, said means being placed at each end of said tie rods (6, 7, 6', 7', 18, 18', 19, 19') characterised a) in that said means for regulating and positioning the first chocks (4, 5) comprise double acting hydraulic actuating cylinders (8, 8', 9, 9') for regulating and positioning said upper (2) and lower (3) rolls, b) in that said hydraulic actuating cylinders (8, 8', 9, 9') associated with the first chocks (4, 5) are connected by means of connecting cross members (10, 11) acting as a support for the first chocks, c) in that ball joints (12, 13) are placed between said connecting cross members (10, 11) and said respective first chocks (4, 5).

2. Rolling stand according to claim 1, wherein said means for regulating and positioning the second chocks (4, 5) comprise double acting hydraulic actuating cylinders (8, 8', 9, 9') for regulating and positioning said rolls with vertical axis.

3. Rolling stand according to claim 2, wherein each chock (4, 5, 16, 17) of the rolls with vertical axis and with horizontal axis is provided with a respective pair of hydraulic actuating cylinders (8, 8', 9, 9', 20, 20', 21, 21').

4. Rolling stand according to claim 3, wherein in correspondence of said ball joints (12, 13) there are placed springs or hydraulic devices for eliminating the clearance present in said joints.

5. Rolling stand according to claim 4, wherein there is provided control means for the independent regulation of the hydraulic chambers of said hydraulic actuating cylinders (8, 8', 9, 9', 20, 20', 21, 21').

6. Rolling stand according to claim 5, wherein said hydraulic actuating cylinders (8, 8', 9, 9', 20, 20', 21, 21') are adapted for hydraulic balancing of at least one roll of said stand.

7. Rolling stand according to claim 6, wherein said hydraulic actuating cylinders (8, 8', 9, 9', 20, 20', 21, 21') have a double stem.

8. Rolling stand according to claim 7, wherein there are provided two rolls (14, 15) with vertical axes.

9. Rolling stand according to claim 8, wherein there are provided four housings (22, 23, 24, 25) two of which being placed on the rolling stand control side and two of which on the operator side, equipped with trolley (30, 31) sliding on guides.

10. Rolling stand according to claim 9, wherein there is provided a basket (26) with trolleys (27, 28), for supporting the rolls with horizontal axis and the guides during rolling stand assembly/disassembly stages.

11. Rolling stand according to claim 10, wherein one or more of the hydraulic double acting actuating cylinders (8, 8', 9, 9', 20, 20', 21, 21') are provided with two respective hydraulic chambers of slightly different sections.

* * * * *